US012226814B2

(12) United States Patent
Heimann et al.

(10) Patent No.: US 12,226,814 B2
(45) Date of Patent: Feb. 18, 2025

(54) METHOD FOR CONTROLLING A COOLING DEVICE IN A ROLLING TRAIN

(71) Applicant: SMS GROUP GMBH, Duesseldorf (DE)

(72) Inventors: Thomas Heimann, Iserlohn (DE); August Sprock, Duesseldorf (DE); Christoph Hassel, Duisburg (DE); Heinz-Juergen Oudehinken, Essen (DE)

(73) Assignee: SMS GROUP GMBH, Duesseldorf (DE)

( * ) Notice: Subject to any disclaimer, the term of this patent is extended or adjusted under 35 U.S.C. 154(b) by 405 days.

(21) Appl. No.: 17/618,968

(22) PCT Filed: Jun. 24, 2020

(86) PCT No.: PCT/EP2020/067681

§ 371 (c)(1),
(2) Date: Dec. 14, 2021

(87) PCT Pub. No.: WO2021/001239

PCT Pub. Date: Jan. 7, 2021

(65) Prior Publication Data

US 2022/0371066 A1 Nov. 24, 2022

(30) Foreign Application Priority Data

Jul. 2, 2019 (DE) ..... 102019209660.3
Oct. 23, 2019 (DE) ..... 102019216261.4

(51) Int. Cl.

| | |
|---|---|
| ***B21B 37/74*** | (2006.01) |
| ***B21B 45/02*** | (2006.01) |
| *B21B 38/00* | (2006.01) |

(52) U.S. Cl.
CPC ..... *B21B 45/0233* (2013.01); *B21B 37/74* (2013.01); *B21B 45/0218* (2013.01); *B21B 2038/004* (2013.01); *B21B 38/006* (2013.01)

(58) Field of Classification Search
CPC . B21B 37/74; B21B 38/006; B21B 2038/004; B21B 45/0218; B21B 45/0233
See application file for complete search history.

(56) References Cited

U.S. PATENT DOCUMENTS 6,860,950 B2 * 3/2005 Franz ..... C21D 11/005 148/661
7,853,348 B2 * 12/2010 Weinzierl ..... C21D 11/005 700/147

(Continued)

FOREIGN PATENT DOCUMENTS

DE 102006047718 A1 4/2008
DE 102012224502 A1 7/2014

(Continued)

OTHER PUBLICATIONS

JP 10-230314A, Hiramoto et al. Sep. 1998.*

(Continued)

*Primary Examiner* — Edward T Tolan
(74) *Attorney, Agent, or Firm* — Amster, Rothstein & Ebenstein LLP

(57) ABSTRACT

A method for controlling a cooling device which is set up to control temperature of a rolling stock such as a metal strip, which runs through a cooling device along a conveying direction of a rolling train. The cooling device is arranged upstream of the rolling train. The method includes determining total enthalpy of a system formed by the rolling stock; determining a measure for the formation of scale, which includes a scale factor that depends on chemical composition and surface temperature of the rolling stock, and a heat transfer coefficient of the scale; calculating a (Continued)

temperature distribution and/or average temperature in the rolling stock based on a temperature calculation model, in which the determined total enthalpy and the measure for the formation of scale are included; and setting a cooling capacity of the cooling device taking into account the calculated temperature distribution and/or average temperature in the rolling stock.

14 Claims, 9 Drawing Sheets

(56) References Cited

U.S. PATENT DOCUMENTS 7,865,341 B2 * 1/2011 Borchers ..... C21D 11/005 703/2
8,369,979 B2 * 2/2013 Weinzierl ..... B21B 37/76 148/511
8,500,927 B2 * 8/2013 Tachibana ..... B21C 51/00 266/46
8,634,953 B2 * 1/2014 Soderlund ..... C21D 9/5732 72/8.2
9,364,879 B2 * 6/2016 Shimoi ..... B21B 37/76

FOREIGN PATENT DOCUMENTS

WO 02/070157 A1 9/2002
WO 2008/043684 A1 4/2008
WO 2009/106423 A1 9/2009
WO 2013/160166 A1 10/2013
WO 2015/113825 A1 8/2015

OTHER PUBLICATIONS

KR 100829943B1, Kim et al. May 2008.*
International Search Report, dated Oct. 9, 2020 in corresponding International Application No. PCT/EP2020/067681.

* cited by examiner

METHOD FOR CONTROLLING A COOLING DEVICE IN A ROLLING TRAIN

CROSS REFERENCE TO RELATED APPLICATIONS

This application is a national phase of PCT application No. PCT/EP2020/067681 filed Jun. 24, 2020, which claims priority to DE patent application No. 102019209660.3, filed Jul. 2, 2019, and DE patent application No. 102019216261.4, filed Oct. 23, 2019, all of which are incorporated herein by reference thereto.

BACKGROUND OF THE INVENTION

Technical Field

The invention relates to a method and a control device for controlling a cooling device which is configured to control the temperature of a rolling stock, preferably a metal strip, which runs through the cooling device along a conveying direction. The cooling device is preferably arranged upstream of a rolling train, in particular between a roughing train and a finishing train.

Background of the Invention

For rolling in a rolling train, in particular in a hot strip mill, it is of great importance to be able to track the temperature distribution in the rolling stock and to be able to regulate the temperature in a targeted manner. Temperatures that are too high or too low in the rolling stock during rolling can adversely affect the mechanical properties of the finish-rolled product. Different metallic materials usually require different thermal and mechanical conditions during forming. The respective time-temperature curves can differ considerably depending on the material and the forming at hand.

It would be ideal if the required temperatures of the rolling stock could be set in a furnace arranged upstream of the rolling train, taking into account the material-specific temperatures, idle times and the like, so that the rolling stock can then be formed in the rolling train with optimal temperature distribution and brought to its final dimensions. However, due to the inertia of such furnaces, this is hardly possible. The furnace temperature would have to be adapted for each rolling stock in accordance with the respective intended forming process. For this reason, such furnaces are generally kept at a high temperature that allows carrying out all forming processes required as part of a production process or a production cycle. However, the temperature set in this way is too high or at least unnecessarily high for many rolled goods, in particular metal strips. In addition, metal strips of different thicknesses cool down at different speeds. A targeted setting of the temperature of the metal strips or metal goods to be rolled is therefore not easily possible.

It is known to stop the metal strip in a roughing train after rolling or to continue moving it at a reduced rolling or conveying speed so that the metal strip cools in the air before entering a finishing train. Another possibility for setting or adapting the temperature is to transport the metal strip at a reduced speed after entering the finishing train, i.e., the metal strip is rolled at a reduced rolling speed. However, such measures result in limiting the rolling schedule and a loss of productivity of the rolling train. In addition, stopping or slowing down the metal strip, results in pauses in which scale problems can occur on the surface of the metal strip.

A further development of the rolling process included installing a cooling system with a so-called pre-strip cooler arranged between the rolling stands of the roughing train and the finishing train. The pre-strip cooler defines a cooling section in which a liquid cooling medium, normally water with or without additives, is applied to the rolling stock. In this case, the pre-strip cooler is configured to set the desired temperature of the rolling stock for finish rolling, depending on the rolling stock, in particular the material to be rolled, and possibly on process parameters. With such a pre-strip cooler, the inlet temperatures in the finishing train can be reduced in a targeted manner. In the case of a steel strip, the temperatures that can be achieved with such a pre-strip cooler are approximately in the range from 1,050° C. to 1,150° C. The temperatures of the rolling stock can be reduced uniformly over the length or, alternatively, a wedge-shaped temperature decrease can be set. In the latter case, the head of the metal strip, i.e., the section that enters the finishing train first, is cooled more strongly than the end of the strip. This can prevent the end of the strip from over-cooling, especially in the case of slow process management.

Before and/or after such a pre-strip cooling, the surface temperature of the metal strip can be measured. However, the temperature distribution or average temperature along the thickness of the metal strip cannot be easily measured.

One possibility to at least approximately determine the temperature distribution or average temperature in the rolling stock is to use a mathematical-physical model. DE 10 2012 224 502 A1 describes a rolling process in which a temperature distribution present in the rolling stock is calculated using a temperature calculation model, the total enthalpy of the rolling stock being processed in the temperature calculation model. An output variable from the temperature calculation model is then used to control the rolling process.

To regulate the pre-strip cooler, in particular to determine the amount of water required to set the desired temperature distribution in the metal strip, calculation methods that are as precise as possible are required. If the rolling train and the temperature of the metal strip entering the rolling train are not sufficiently coordinated with one another, this can lead to productivity and/or quality losses.

SUMMARY OF THE INVENTION

One object of the invention is to further improve the calculation of the temperature distribution in the rolling stock, in particular in order to be able to predict and regulate the inlet temperature of the rolling stock in a rolling train as precisely as possible.

This object is achieved with a method having the features of the independent claim and a control device with the features of claim. Advantageous developments are set forth in the dependent claims, the following presentation of the invention and the description of preferred exemplary embodiments The method according to the invention is used to control a cooling device which is configured to control the temperature of a rolling stock. The rolling stock is preferably a metal strip. While metal strips made of steel are particularly suitable, the method can be used for all or at least many other metallic materials, for example made of an aluminum, nickel or copper alloy, in strip, sheet metal, tube or some other form. The rolling stock is transported through the cooling device along a conveying direction. The cooling device is particularly preferably part of a rolling mill. For example, it is arranged upstream of a rolling train in order to bring the rolling stock to a temperature suitable for rolling. The cooling device is preferably arranged between a roughing train and a finishing train, each of which has one or more roll stands for rolling the rolling stock.

According to the invention, a total enthalpy of the system formed by the rolling stock is determined. At high temperatures, scale formation occurs on the surface of the rolling stock. The scale layer reduces the heat given off by radiation and influences the heat conduction. For this reason, a measure for the scale formation is also determined. This measure preferably includes a scale factor that depends on the chemical composition and the surface temperature of the rolling stock. The temperature distribution and/or average temperature in the rolling stock is then calculated on the basis of a temperature calculation model, which includes the total enthalpy determined and the measure for the formation of scale. After the temperature distribution in the rolling stock is known, a cooling capacity of the cooling device is set taking into account the calculated temperature distribution and/or average temperature.

The method improves the calculation of the rolling stock temperature. In particular, the accuracy of the temperature distribution and/or average temperature is improved by taking the formation of scale into account. As a result, the cooling device can be regulated in such a way that the rolling stock has the desired average temperature or temperature distribution when emerging from the cooling device. If a rolling train, for example a finishing train, follows the cooling device, the optimal inlet temperature of the rolling stock in the rolling train can be set in this way by regulating the cooling device during rolling without any pauses. Thus, with the calculation of the temperature distribution or average temperature in the rolling stock based on the temperature calculation model, the inlet temperature of the rolling stock in the rolling train, preferably the finishing train, arranged downstream of the cooling device is calculated. Depending on the application, i.e., depending on the forming process, this means avoiding unnecessary productivity and/or quality losses. The cooling device, in particular as a pre-strip cooling, also reduces surface defects caused by the formation of scale. Furthermore, the method enables a homogenization of temperature irregularities in the rolling stock via a defined adjustable cooling power of the cooling device.

The total enthalpy of the rolling stock is preferably calculated from the sum of the free molar enthalpies of all the pure phases and/or phase fractions present in the rolling stock. Such a breakdown enables the total enthalpy to be calculated for a large number of different metallic materials using one and the same temperature calculation model.

The temperature calculation model is preferably based on a non-stationary heat equation, for example on a partial differential equation, which relates the spatial temperature distribution in the rolling stock to the development of the total enthalpy over time. The heat equation, for example Fourier's heat equation, can be solved by means of a conventional numerical technique, for example by simulation, for the corresponding boundary conditions, given by the process environment in the cooling section. This enables the temperature distribution in the rolling stock to be determined with the desired accuracy.

Preferably, the sequence of determining the total enthalpy, possibly determining the degree of scale formation, calculating the temperature distribution and setting the cooling capacity is carried out iteratively or cyclically, so that a desired temperature distribution or average temperature in the rolling stock is approximated. At the beginning of the iteration, the initial conditions are defined: for example, the rolling stock temperature is set to an initial value T0, which is the surface temperature prior to entry into the cooling section; the scale thickness is set to 0 mm, for example, and the average cooling rate, for example, to 5 K/s as the default value. Based on this, the iteration is started, whereby the calculated temperature profile gradually approximates a quasi-stationary temperature profile. "Quasi-stationary" here means that the temperature profile can be changed by regulating the cooling device and is also used to adjust the inlet temperature in any rolling train.

The cooling capacity of the cooling device is preferably set by comparison with a threshold value or a tolerance. That is, if the calculated temperature distribution deviates from a target temperature distribution by more than a specified tolerance, the cooling capacity is adapted. Otherwise, there is no need to change the cooling capacity. The entire calculated temperature distribution does not necessarily have to be used for this decision, but for the sake of simplicity one or more temperature values or the average temperature can be compared with a corresponding setpoint. For example, the setpoint and actual value of the surface temperature at the outlet of the cooling device can be compared with one another. If the difference is outside the specified tolerance, for example of ±2° C., the cooling capacity is adjusted.

The cooling device preferably has a nozzle arrangement with a plurality of nozzles, which is configured to supply the nozzles with a fluid cooling medium, preferably water or a water mixture, the cooling capacity of the cooling device in this case being set by the amount of cooling medium output by the nozzles. In this way, the cooling capacity of the cooling device can be adjusted in a simple and direct manner.

Preferably, one or more temperature measuring devices are provided, the measurement values of which are included in the determination of the total enthalpy and/or determination of the measure for the formation of scale and/or in some other way in the temperature calculation model. Thus, a first temperature measuring device can be arranged directly downstream of the roughing train and a second temperature measuring device can be arranged directly upstream of the finishing train. Of course, alternative or further temperature measuring devices can be located in the cooling section, in the roughing train and/or finishing train, as well as sensors for determining further physical variables, such as the conveying speed of the rolling stock. The temperature measuring devices preferably work without contact and are generally designed to essentially detect the surface temperature of the rolling stock. The measurement data of the temperature measuring devices and possibly further sensors are sent to a control device, either via cables or wirelessly, where they are further processed with the help of the temperature calculation model in order to obtain control variables for controlling the cooling device and possibly further system parts, such as the roughing and/or finishing train. The control commands are also sent via cables or wirelessly to the corresponding actuators, such as pumps and/or valves, of the cooling device, whereby the cooling performance of the cooling device can be varied temporally and/or spatially along the cooling path.

When calculating the total enthalpy, phase transition temperatures are preferably determined by means of a regression method which uses regression coefficients which are preferably obtained from a calculated or empirically obtained TTT diagram (time-temperature transformation diagram). Since the conversion temperatures can be determined very precisely using calculated TTT diagrams, the temperature calculation can be carried out particularly precisely and with the greatest possible reliability of the input data.

In the context of the temperature calculation model, the total enthalpy is preferably determined as the free molar total enthalpy H of the rolling stock by means of the Gibbs energy G at constant pressure p according to the equation $$H = G - T\left(\frac{\partial G}{\partial T}\right)p$$

where Tis the absolute temperature in Kelvin.

For a phase mixture, the Gibbs energy G of the overall system is preferably expressed as the sum of the Gibbs energies of the pure phases and phase fractions according to the equation $$G = \sum_i f^i G^i$$

where $f^i$ denotes the Gibbs energy fraction of the respective phase or the respective phase fraction in the overall system and $G^i$ denotes the Gibbs energy of the respective pure phase or the respective phase fraction of the system.

Since the total enthalpy as an input variable in the temperature calculation can be specified with the Gibbs energies for almost all metallic materials currently manufactured worldwide, and the transformation temperatures can be determined very precisely using calculated TTT diagrams, for example, the temperature can be calculated particularly precisely and with the greatest possible reliability of the input data.

The rolling stock preferably consists of steel, with proportions of austenite, ferrite and liquid phase, wherein the liquid phase generally is no longer present in the case of metal strips during the rolling process. In this case, the Gibbs energy of the respective phases is preferably calculated according to the following equation $$G^\phi = \sum_{i=1}^{n} x_i^\phi G_i^\phi + RT\sum_{i=1}^{n} x_i \ln x_i + {}^E G^\phi + {}^{magn} G^\phi$$

where $G^\phi$ denotes the Gibbs energy of a respective phase $\phi$, $xi\phi$ the mole fraction of the i-th component of the respective phase $\phi$, $Gi^\phi$ the Gibbs energy of the i-th component of the respective phase $\phi$, R the general gas constant, T the absolute temperature in Kelvin, ${}^E G^\phi$ the Gibbs energy for a non-ideal mixture and ${}^{magn}G^\phi$ the magnetic energy of the system.

Here, the Gibbs energy for a non-ideal mixture, ${}^E G^\phi$ is preferably determined according to the equation $${}^E G^\phi = \Sigma x_i x_j {}^a L^\phi_{i,j}(x_i - x_j)^a + \Sigma x_i x_j x_k L_{i,j,k}{}^\phi$$

where $x_i$ is the mole fraction of the i-th component, $x_j$ is the mole fraction of the j-th component, $x_k$ is the mole fraction of the k-th component, a is a correction term, ${}^a L^\phi_{i,j}$ and ${}^a L^\phi_{i,j,k}$ designate interaction parameters of various orders of the overall system formed by the rolling stock.

The proportion of the magnetic energy ${}^{mag}G^\phi$ is preferably determined according to the equation $${}^{mag}G^\phi = RT\ln(1+\beta)f(\tau)$$

where R is the general gas constant, T is the absolute temperature in Kelvin, $\beta$ is the magnetic moment and $f(\tau)$ is the part of the overall system as a function of the normalized Curie temperature $\tau$ of the overall system formed by the rolling stock.

The transformation kinetics of the phases is preferably determined using a diffusion-controlled approach according to the Enomoto equation; more precisely by means of the following equation:

$$\frac{x_C^0 - x_C^\alpha}{x_C^\gamma - x_C^0} f^\alpha = \left\{1 - \frac{6}{\pi^2}\sum_{n=1}^{\infty}\frac{1}{n^2} * \exp\left[-\frac{n^2\pi^2 4(T_0 - T)D_C^\gamma}{(1-f^\alpha)^{\frac{2}{3}} d^2 \dot{T}}\right]\right\}(1 - f^\alpha)$$

Here, $x_c^0$ denotes the carbon concentration in the volume, $x_c^\alpha$ the carbon concentration at the phase boundary on the ferrite side and $x_c^\lambda$ the carbon concentration at the phase boundary on the austenite side. The carbon concentrations are calculated from the equilibrium concentrations, which in turn result from the equilibrium of the chemical potentials at the phase boundaries. $T_0$ denotes the start temperature of the phase transition, T the current temperature of the rolling stock, and $\dot{T}$ denotes the cooling rate. The start temperature for the phase transition is preferably determined from the regression equations of the TTT diagrams. $D_c^y$ denotes the diffusion constant of carbon in austenite according to $$D_C^\gamma = (1 + y_C^\gamma) * \left[1 + y_C^\gamma * (1 - y_C^\gamma) * \frac{8339.9}{T}\right] * 0.00453 * \exp\left[-\left(\frac{1}{T} - 0.0002221\right) * (17767 - 26436 * y_C^\gamma)\right] \quad (12)$$

with d as austenite grain size.

With the temperatures of the phase boundaries and the microstructural components obtained in this way, the total enthalpy can be determined with great accuracy.

In the context of the temperature calculation model, the thickness of the scale forming on the rolling stock after a period of time is preferably determined according to the following calculation formula $$D_Z(t + dt) = \sqrt{D_Z(t)^2 + F_Z \cdot dt}$$

$$\text{with } dt = \frac{d_Z}{v}$$

where $D_Z(t)$ denotes the thickness of the scale, t the time, dt the period of time, $F_Z$ the scale factor, v the conveying speed of the rolling stock and $d_Z$ a distance covered in the period dt at the conveying speed v.

The scale factor $F_Z$ is preferably calculated as a function of the surface temperature of the rolling stock and its chemical composition in accordance with the equation $$F_{Z=a\cdot e^{-b\cdot c\,\%}\cdot e^{-c/T_0}}$$

where $T_o$ is the surface temperature of the rolling stock and C % is the dimensionless concentration of carbon in the material of the rolling stock. a, b and c are coefficients known from the literature; See, for example, R. Viscorova, Investigation of the heat transfer during spray water cooling with special consideration of the influence of scaling, TU Clausthal, Dissertation, 2007. The above equation for determining the scaling factor provides particularly good results for metal, especially steel, with small silicon contents, in particular less than 2% by weight. In this case, for example, the coefficients are: a=9.8*10$^7$, b=2.08, c=17780.

The heat transfer coefficient of the scale is preferably taken into account according to the equation $$\alpha_z(D_z, \lambda_z) = \left(\frac{\lambda_z}{D_z}\right)$$

where $\alpha_Z(D_Z, \lambda_Z)$ denotes the heat transfer coefficient of the scale, $D_Z$ the thickness of the scale and $\lambda_Z$ the coefficient of thermal conductivity of the scale.

The above-mentioned object is also achieved by a control device for controlling a cooling device which is configured to control the temperature of a rolling stock, preferably a metal strip, which runs through the cooling device along a conveying direction. The control device is configured to carry out a method as described above.

For this purpose, the control device can be implemented locally or in a decentralized manner. For example, the control device can comprise a plurality of computing devices which communicate with one another via a network. The control device can be adapted flexibly and inexpensively, for example by means of appropriate programming.

The features, technical effects, advantages and exemplary embodiments that have been described in relation to the method apply analogously to the control device.

While the specific examples set forth above are based on a metal strip made of steel, the invention can also be used for many other types of metallic materials, for example aluminum, nickel or copper alloys, as well as rolled goods of other geometries.

Further advantages and features of the present invention can be seen from the following description of preferred exemplary embodiments. The features described there can be implemented alone or in combination with one or more of the features set forth above, provided the features do not contradict one another. In the following, exemplary preferred embodiments are described with reference to the accompanying drawings.

DETAILED DESCRIPTION OF PREFERRED EMBODIMENTS

In the following, preferred exemplary embodiments are described with reference to the Figures. Identical, similar or identically acting elements are provided with identical reference symbols, and a repetitive description of these elements is in some cases omitted to avoid redundancies.

Figure 1:
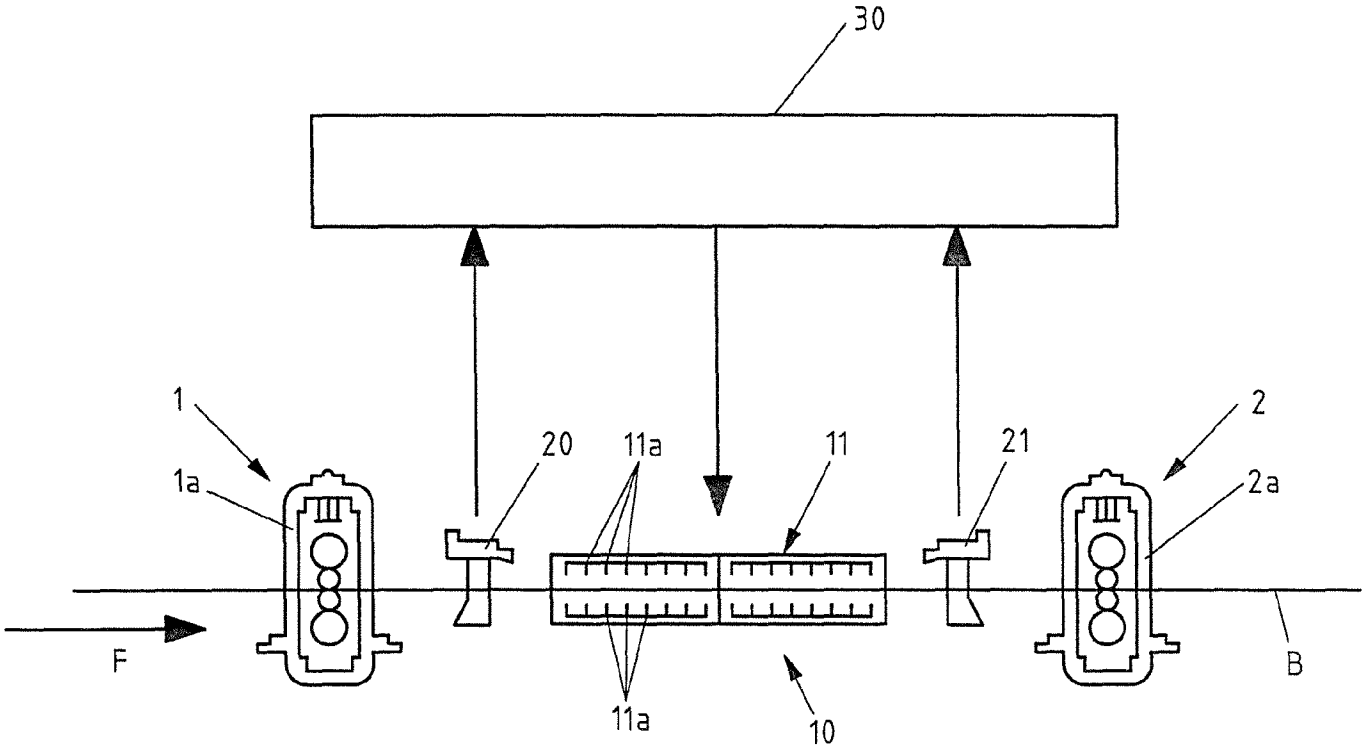
FIG. 1 is a schematic representation of a cooling device arranged between a roughing train and a finishing train.

FIG. 1 is a schematic representation of a cooling device 10, implemented in the present exemplary embodiment as a so-called pre-strip cooler, between a roughing train 1 and a finishing train 2.

The roughing train 1 and the finishing train 2 each have one or more roll stands 1*a*, 2*a* for rolling a rolling stock that is transported through the system along a conveying direction F. In the following, a metal strip B is used as the rolling stock. The roughing train 1 is preferably used to roll a pre-strip from a slab, which for example comes from a continuous caster. After passing through the cooling device 10, the pre-strip is finish-rolled by the finishing train 2 to the desired final thickness.

The finished sheet, the pre-strip and all intermediate products fall under the term "metal strip". Furthermore, the term "metal strip" includes all metals and alloys suitable for rolling in sheet form, in particular steel and non-ferrous metals such as aluminum or nickel alloys.

In FIG. 1, the last roll stand 1*a* of roughing train 1 and the first roll stand 2*a* of finishing train 2 are shown by way of example. Here, spatial relationships such as "upstream of", "downstream of", "first", "last" etc. are to be understood in relation to the conveying direction F.

The cooling device 10 has a nozzle arrangement 11 with a plurality of nozzles 11*a*. The nozzle arrangement 11 defines a continuous cooling section in which the metal strip B is cooled in a targeted manner and which preferably begins immediately downstream of the roughing train 1 and ends immediately upstream of the finishing train 2. It should be pointed out, however, that other units, such as a descaling machine, a heat insulating hood, scissors and the like, can also be installed in the area between the roughing train 1 and the finishing train 2.

The nozzle arrangement 11 has a fluid system with pump(s), distribution line(s), valve(s) and the like, not shown in detail in the Figure which is configured to supply a cooling medium, preferably water or a water mixture, to the nozzles 11*a*. The nozzles 11*a* are configured to spray the cooling medium onto the metal strip B, in particular the two strip surfaces. For this purpose, the nozzles 11*a* are suitably positioned and aligned in order to apply a variable amount of cooling medium to the metal strip B, preferably controllable in sections along the cooling path.

In order to be able to control the cooling performance in the cooling section in a targeted manner, as explained in detail below, one or more temperature measuring devices 20, 21 are preferably located between roughing train 1 and finishing train 2. In the present example, a first temperature measuring device 20 is located directly downstream of roughing train 1 and a second temperature measuring device 21 is arranged directly in upstream of finishing train 2. Of course, alternative or further temperature measuring devices can be located in the cooling section, in roughing train 1 and/or finishing train 2, as well as sensors for determining further physical variables, such as the conveying speed of metal strip B, for example. The temperature measuring devices 20 preferably work without contact and are generally designed to essentially determine the surface temperature of the metal strip B. If the surface temperature is known at one or more points between the roughing train 1 and the finishing train 2, temperature measuring devices 20, 21 can optionally be dispensed with.

The measurement data of the temperature measuring devices 20, 21 and any other sensors are sent to a control device 30, via cable or wirelessly, where they are further processed with the aid of a physical model in order to obtain control variables for controlling the cooling device 10. The control commands are also sent by cable or wirelessly to the corresponding actuators, such as pumps and/or valves, of the cooling device 10, whereby the cooling performance of the cooling device 10 can be varied in terms of time and/or space along the cooling path, around the metal strip B as precisely as possible to bring to the temperature required for the finishing train 2.

It should be noted that the system structure described above is only exemplary. The process control described herein can be used for cooling devices of any kind, the task of which is to cool a metallic product, in particular rolled stock, in a targeted manner to a desired final temperature. The cooling device 10 does not necessarily have to be arranged downstream of a roughing train 1 with roll stands 1*a* or, in particular, between a roughing train 1 and a finishing train 2. The cooling device 10 can, for example, also be arranged between two roll stands 1*a* of a roughing train 1 or between two roll stands 2*a* of a finishing train 2.

Since the temperatures inside the metal strip B cannot be measured, a physical model is used to determine the temperatures. With the help of the model, the temperature distribution in the metal strip B can be determined as a function of the process conditions using a temperature calculation program.

In the following, first the basic principle underlying the temperature calculation program are described. Subsequently, an exemplary process sequence for regulating the cooling device 10 is presented.

The core task of the temperature calculation program relates to the calculation of the pre-strip temperature, that is to say the temperature distribution in the metal strip B at the moment of entry into the cooling device 10, which metal strip B may have previously passed through the roughing train 1. The calculation is preferably carried out using a finite difference method. For this purpose, the metal strip B is mathematically divided into thin strips. The boundary conditions are formulated taking into account the dimensions of the cooling zones of the cooling device 10, the quantities and temperature of the cooling medium and the ambient temperature.

The calculation of the temperature distribution also includes process variables such as the strip speed and the surface temperature of the strip as well as the thickness and/or the chemical composition of the metal strip B, and are therefore immediately and instantaneously included in the calculation in the event of a change. The result is a temperature distribution in the metal strip B.

The basis of the temperature calculation is the transient heat equation, see equation (1) below, which takes thermal boundary conditions and Fourier's law into account, according to which a heat flow in the direction of the temperature gradient is established depending on the thermal conductivity λ. The density ρ and the enthalpy H of the material are included in the equation. The energy released during the conversion can be combined with the heat capacity to form a total enthalpy H. Let s denote the position coordinate along the thickness direction, and T indicates the calculated temperature. Then the following applies (cf. Miettinen, S. Louhenkilpi; 1994; "Calculation of Thermophysical Properties of Carbon and Low Alloyed Steels for Modeling of Solidifaction Processes"):

$$\rho\frac{dH}{dt} - \frac{\delta}{\delta s}\left(\lambda\frac{\delta T}{\delta s}\right) = 0 \tag{1}$$

As necessary input variables for the calculation of the temperature distribution, the heat conduction or thermal conductivity λ and the total enthalpy H are particularly important, since these variables have a decisive influence on the temperature result. The thermal conductivity λ is a function of the temperature, the chemical composition and the phase proportion and can be determined experimentally for the pure phases. However, the enthalpy H cannot be measured and for certain chemical compositions of the metal strip B can only be described imprecisely with approximate equations. Any numerical solution to the above differential equation (1) can therefore lead to inaccurate temperature results. The energy flowing in or out from outside (heat transfer by convection) is taken into account in the thermal boundary conditions.

In order to increase the accuracy of the calculation, the aim is to determine the overall enthalpy curve with phase boundaries that are as exact as possible. For this purpose, the molar enthalpy of the system, here of the metal strip B, is calculated using the Gibbs energy according to the following equation $$H = G - T\left(\frac{\partial G}{\partial T}\right)p \tag{2}$$

Here H denotes the molar enthalpy of the system, G the molar Gibbs energy of the entire system and T the absolute temperature in Kelvin. For a phase mixture, the Gibbs energy of the overall system can be calculated using the Gibbs energies of the pure phases and their phase proportions according to the following equation $$G = \sum_i f^i G^i \tag{3}$$

Here $f^\phi$ denotes the phase portion of phase ϕ and $G^\phi$ denotes the molar Gibbs energy of this phase ϕ. For the austenite, ferrite and liquid phase, the Gibbs energy is:

$$G^\phi = \sum_{i=1}^{n} x_i^\phi G_i^\phi + RT\sum_{i=1}^{n} x_i \ln x_i + {}^{E}G^\phi + {}^{magn}G^\phi \tag{4}$$

$${}^{E}G^\phi = \sum x_i x_j {}^{a}L_{i,j}^\phi (x_i - x_j)^a + \sum x_i x_j x_k L_{i,j,k}^\phi \tag{5}$$

$${}^{magn}G^\phi = RT\ln(1+\beta)f(\tau) \tag{6}$$

In the equation (4), the terms correspond to the single element energy, a contribution for the ideal mixture and a contribution for the non-ideal mixture (equation 5)) and the magnetic energy (equation (6)).

In detail, $G^\phi$ denotes the Gibbs energy of a phase ϕ, $x_i^\phi$ denotes the mole fraction of the i-th component of the corresponding phase ϕ, $G_i^\phi$ denotes the Gibbs energy of the i-th component of the corresponding phase ϕ, R denotes the general gas constant, T denotes the absolute temperature in Kelvin, ${}^{E}G^{\Phi}$ denotes the Gibbs energy for a non-ideal mixture, ${}^{mag}G^{\Phi}$ denotes the magnetic energy of the system, a denotes a correction term, and ${}^{a}L^{\Phi}_{i,j}$ and ${}^{a}L^{\Phi}_{i,j,k}$ denote interaction parameters of different order of the metal band B. formed overall system. Furthermore, β denotes the magnetic moment, and f(τ) denotes the proportion of the overall system as a function of the normalized Curie temperature τ of the overall system formed by the metal strip B.

The parameters of the terms of equations (6) to (8) can be obtained from a database, for example, and used to determine the Gibbs energies of a steel composition of the metal strip B, for example. With the help of a mathematical derivation, this gives the total enthalpy of this steel composition.

Figure 2:
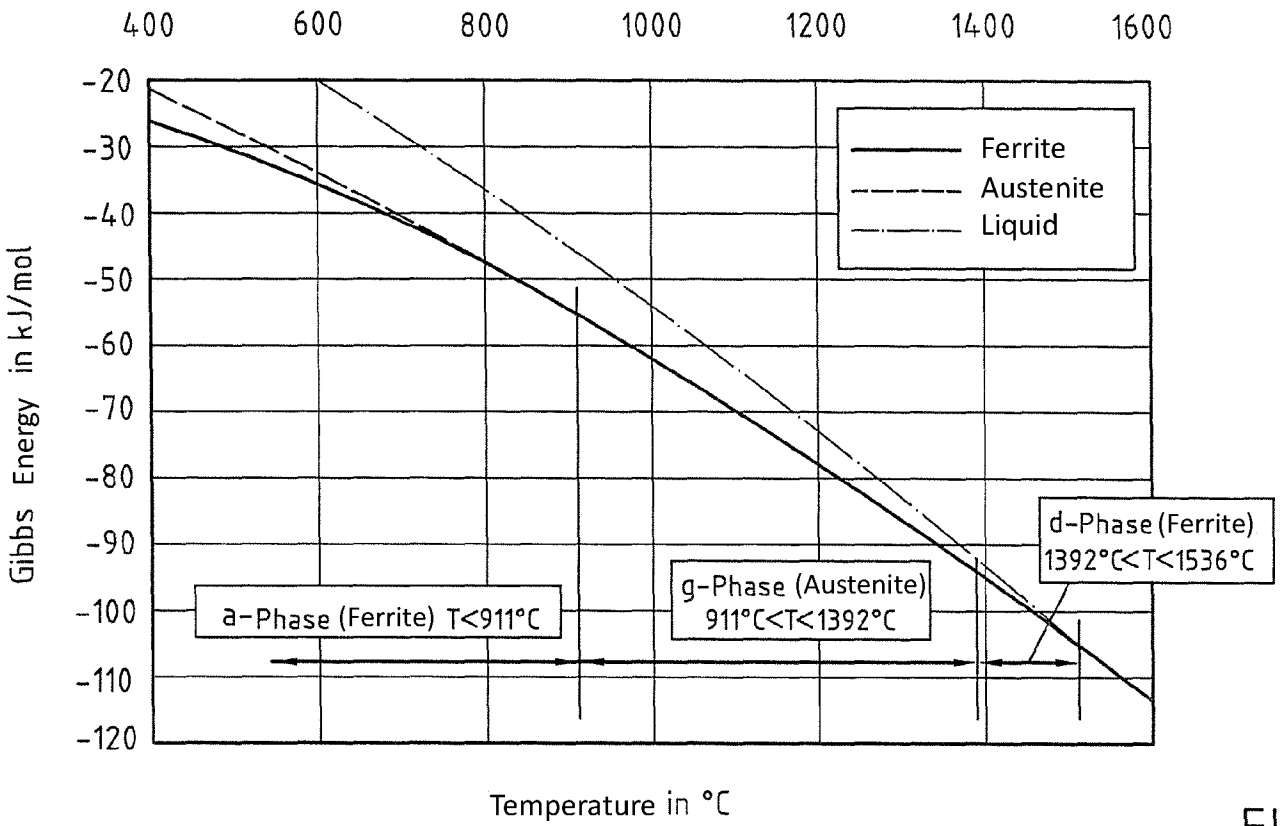
FIG. 2 is a graph showing Gibbs energy as a function of temperature for pure iron.

FIG. 2 is a diagram showing the Gibbs energy as a function of temperature for pure iron. From FIG. 2 it can be seen that the individual phases ferrite, austenite and the liquid phase assume a minimum for a characteristic temperature range at which these phases are stable.

In principle, it is thus possible to create a phase diagram for every steel composition. With the Gibbs energies, the phase transitions are determined exactly and the stable phase components are represented.

Such a phase diagram is correct for the state of equilibrium. Since the rolling process in connection with the cooling process is not a state of equilibrium but a dynamic process, the phase transition temperatures must also be calculated in the dynamic case. In the cooling device 10, for example, a cooling rate of 5 to 20° C./s, for steel of 5 to 10° C./s, is achieved. For such cooling rates and higher cooling rates, the phase transition temperatures can no longer be derived from the respective equilibrium diagram. The so-called TTT diagrams (time-temperature transformation diagrams) are therefore used.

Figure 3:
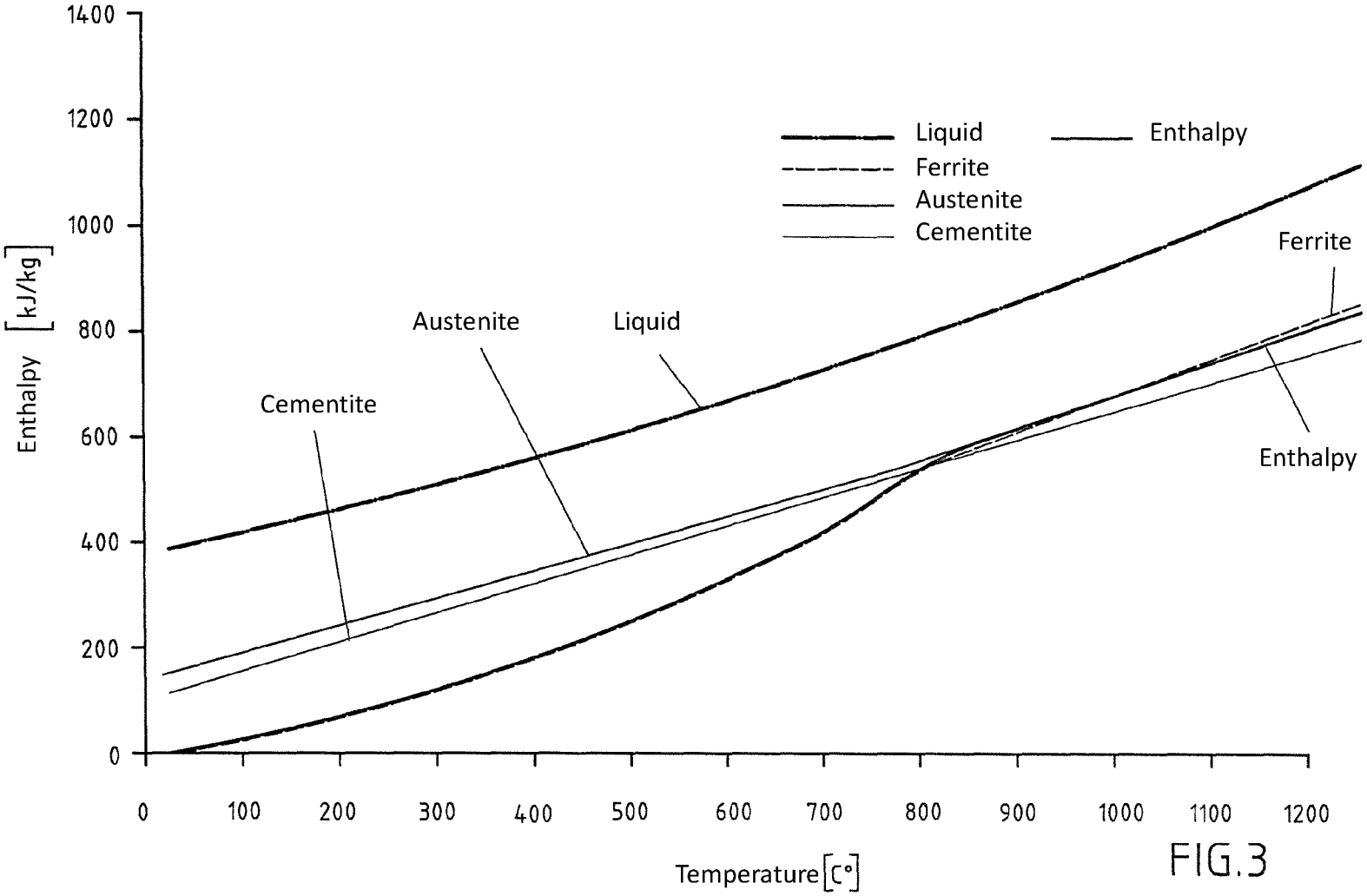
FIG. 3 is a diagram showing the course of the total enthalpy according to Gibbs for a low-carbon steel with known phase boundaries.

FIG. 3 shows the course of the total enthalpy according to Gibbs for a low-carbon steel with known phase boundaries.

The phase transition temperatures are now determined using regression methods. The regression coefficients are preferably derived from a large number of different ZTU diagrams. The equations for a metal strip B made of steel have the form:

$$T^{\Phi}=F\text{ (Analysis, austenite grain size, cooling rate)} \tag{7}$$

$$\dot{T}=F\text{ (Analysis, austenite grain size)} \tag{8}$$

More precisely:

$$T^{\Phi} = a_0 + \sum_{i=1}^{n} a_i C_i + \sum_{i=1}^{n}\sum_{j=i}^{n} b_{ij} C_i C_j + c_1 M + c_2\sqrt{\dot{T}} + c_3 \ln(\dot{T}) \tag{9}$$

$$\log(\dot{T}^{\Phi}) = a_0 + \sum_{i=1}^{n} a_i C_i + \sum_{i=1}^{n}\sum_{j=i}^{n} b_{ij} C_i C_j + c_1 M \tag{10}$$

Here, $T^{\Phi}$ denotes the transformation temperatures at which the structure of ferrite, pearlite, bainite or martensite is formed or the formation of pearlite is terminated. $\dot{T}$ and $\dot{T}^{\Phi}$ indicate the maximum cooling rate at which ferrite or pearlite is formed, whether the structure contains 100% ferrite and pearlite, or whether 20, 80 or 100% martensite is formed. In equations (9) and (10), $a_i$, $b_{ij}$ and $c_i$ denote regression constants and $C_i$, $C_j$ denote the concentrations of the individual elements in percent by weight. The number of analysis components of the chemical composition of the metal strip B taken into account is denoted by n. M is the ASTM grain size and can have values in the range from 1 to 10. With these parameters it is possible to construct a TTT diagram or TTT diagram.

Figure 4:
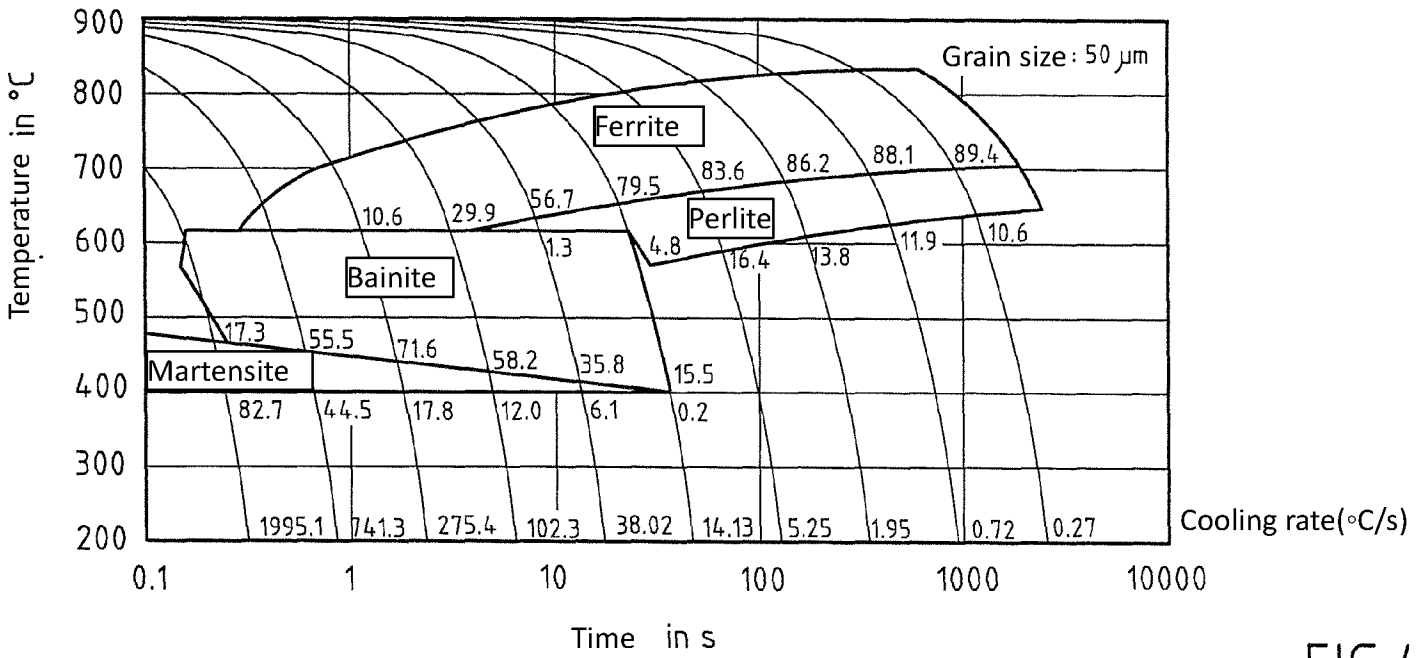
FIG. 4 is a TTT diagram that was determined for a low-carbon material using regression equations.

FIG. 4 shows an exemplary TTT diagram for a low-carbon material that was determined using the specified regression equations.

The transformation kinetics between the individual phases can be described using a diffusion-controlled approach with an Enomoto equation as follows:

$$\frac{x_C^0 - x_C^{\alpha}}{x_C^{\gamma} - x_C^0} f^{\alpha} = \left\{1 - \frac{6}{\pi^2}\sum_{n=1}^{\infty}\frac{1}{n^2} * \exp\left[-\frac{n^2\pi^2 4(T_0 - T)D_C^{\gamma}}{(1-f^{\alpha})^{\frac{2}{3}} d^2 \dot{T}}\right]\right\}(1 - f^{\alpha}) \tag{11}$$

Here, $x_c^0$ denotes the carbon concentration in the volume, $x_c^{\alpha}$ the carbon concentration at the phase boundary on the ferrite side and $x_c^{\lambda}$ the carbon concentration at the phase boundary on the austenite side. The carbon concentrations are calculated from the equilibrium concentrations, which in turn result from the equilibrium of the chemical potentials at the phase boundaries. $T_0$ denotes the start temperature of the phase transition, T the current temperature of the metal strip B, here the steel pre-strip, and denotes the cooling rate. The starting temperature for the phase transition is determined from the regression equations of the TTT diagrams. $D_c^{y}$ denotes the diffusion constant of carbon in austenite according to $$D_C^{\gamma} = (1 + y_C^{\gamma}) * \left[1 + y_C^{\gamma} * (1 - y_C^{\gamma}) * \frac{8339.9}{T}\right] * 0.00453 * \exp\left[-\left(\frac{1}{T} - 0.0002221\right) * (17767 - 26436 * y_C^{\gamma})\right] \tag{12}$$

with d as austenite grain size.

With the thus obtained phase boundaries and the structural proportions, the total enthalpy can be determined. In Fourier's heat conduction equation, in addition to enthalpy, temperature-dependent and phase-dependent heat conduction or thermal conductivity and density also appear. These material-dependent values are determined for each structural phase of the metal strip B using regression equations.

For an exact temperature calculation and control of the quantities of cooling medium required, i.e. to be sprayed, in the cooling device 10, knowledge of these material quantities is important.

At high temperatures, scale formation occurs on the strip surface of the metal strip B, which is increased by longer idle or pause times of the metal strip B during the forming process. The layer of scale that forms reduces the heat given off by the metal strip B through radiation. When calculating the temperature distribution in metal strip B, this reduced heat transfer to the environment due to the scale layer is taken into account. To do this, it is necessary to determine the scale layer that forms, which can be done as follows:

The increase in the scale thickness $D_Z$ in a time increment dt is calculated according to $$D_Z(t+dt) == \sqrt{D_Z(t)^2 + F_Z \cdot \mathrm{dt}} \tag{13}$$

where $D_Z(t)$ denotes the scale thickness at time t, $F_Z$ denotes the scale factor and dt denotes the scale time. The "scaling time" denotes the time interval between two calculation points in the longitudinal direction of the metal strip B. Thus, the scaling time can be specified as $dt=D_Z/v$, where v indicates the known and/or measurable conveying speed of the metal strip B. The variable $d_Z$ denotes the distance covered in the time dt. The scale factor $F_Z$ is dependent on the surface temperature of the metal strip B and the chemical analysis of its material composition (steel)

$$F_{Z=a\cdot e^{-b\cdot c\,\%}\cdot e^{-c/T_0}} \tag{14}$$

where $T_o$ is the surface temperature of the metal strip B and C % is the dimensionless concentration of carbon in the material. a, b and c are coefficients known from the literature; See, for example, R. Viscorova, Investigation of the heat transfer in spray water cooling with special consideration of the influence of scaling, TU Clausthal, dissertation, 2007.

Equation (14) given above yields particularly good results for metal, in particular steel, with small silicon contents, in particular less than 2% by weight. For example, in this case the coefficients are: a=9.8*107, b=2.08, c=17780.

Figure 5:
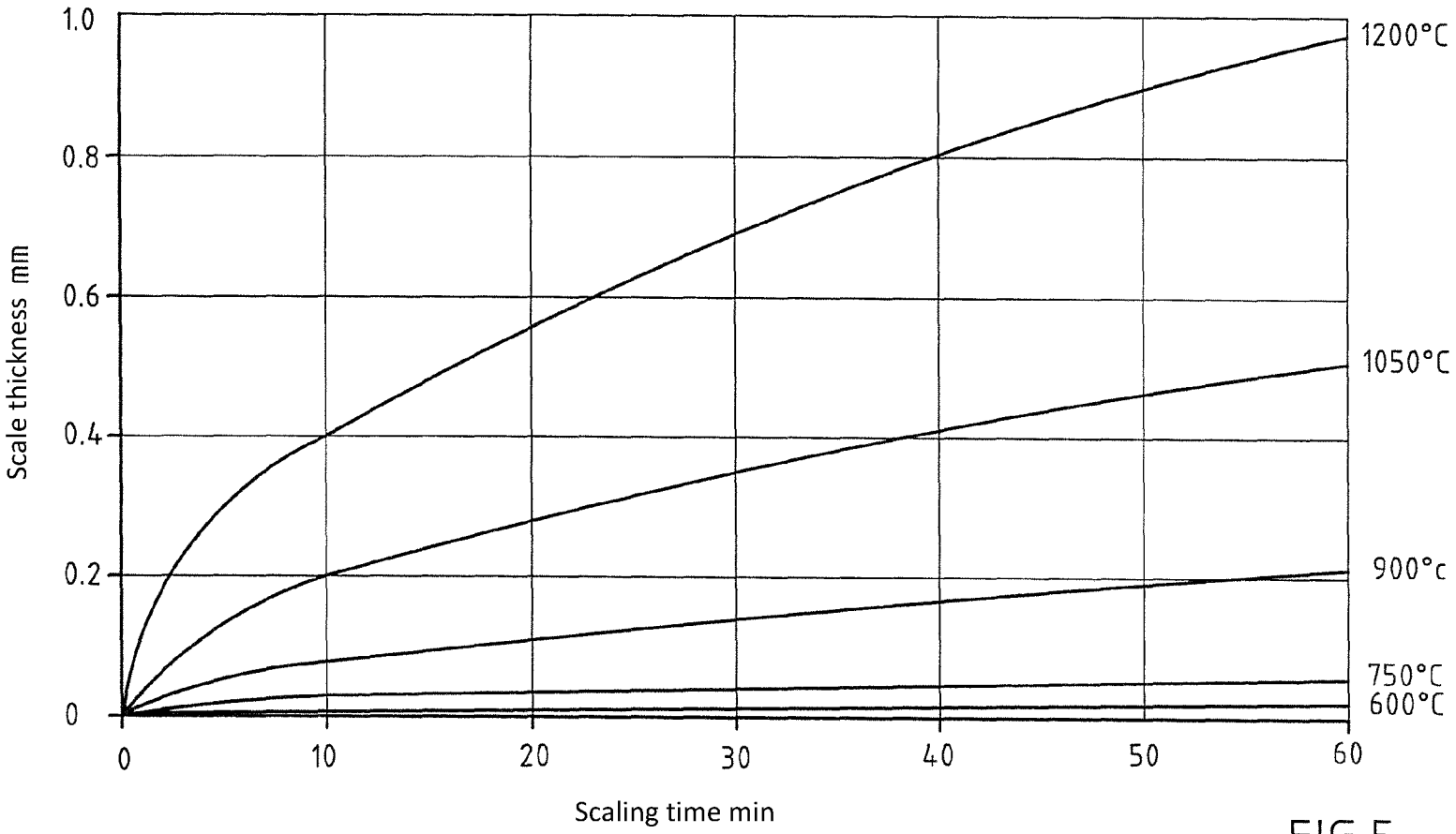
FIG. 5 is a diagram showing the scale thickness as a function of the scaling time at different surface temperatures.
Figure 6:
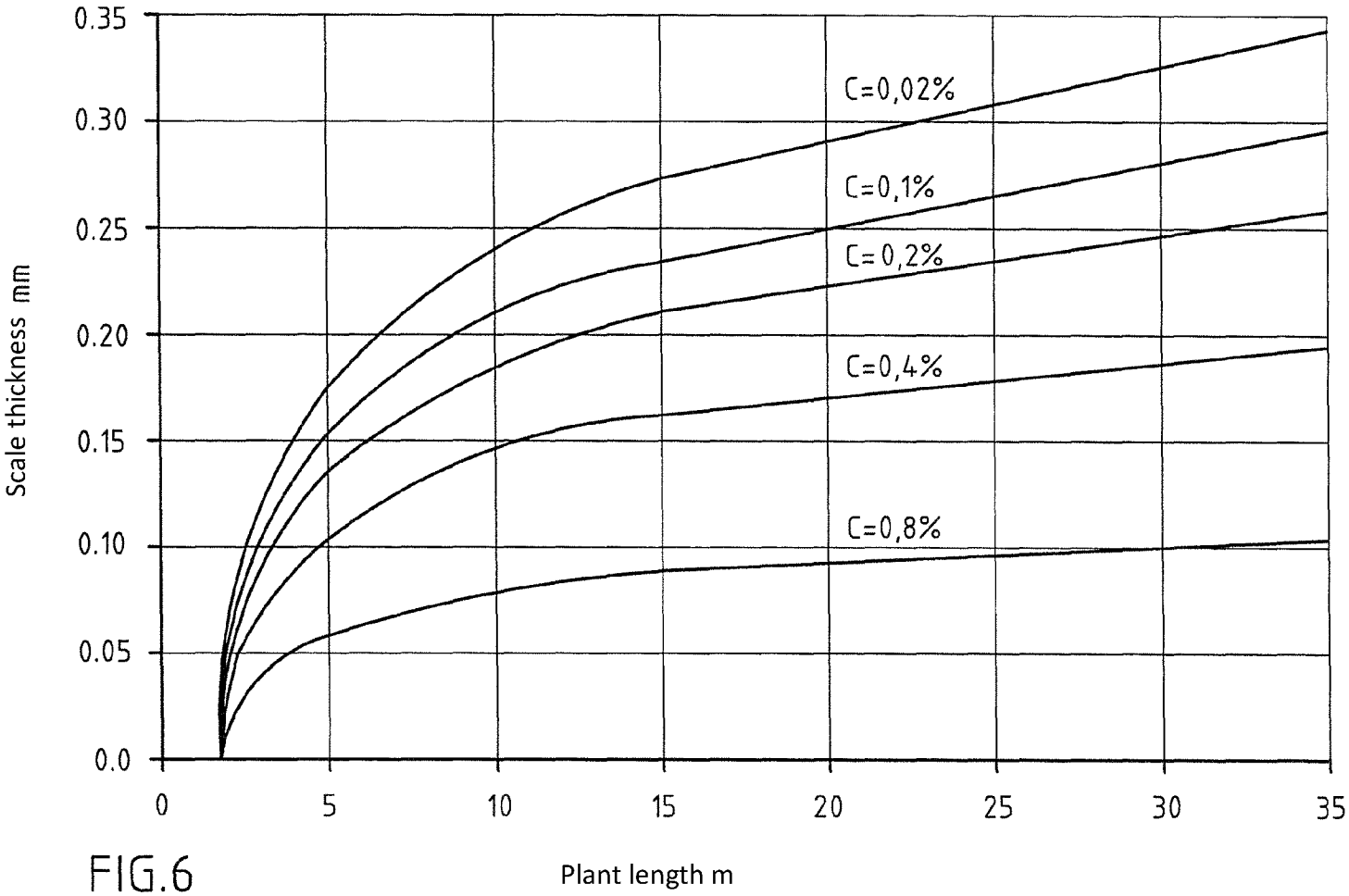
FIG. 6 is a diagram showing the scale thickness as a function of the plant length for various carbon contents.

FIG. 5 is a diagram showing the scale thickness as a function of the scaling time at different surface temperatures. FIG. 6 is a diagram showing the scale thickness as a function of the plant length for various carbon contents.

The formation of scale therefore depends heavily on the analysis, in particular on the carbon content of the material. A low carbon content results in more scale formation than a higher carbon content. Pure iron scales more strongly than steel with a higher carbon content. In addition to the scaling time, the scale growth also depends heavily on the surface temperature of the metal strip B. The layer of scale hinders heat dissipation of the metal strip B.

The thermal conductivity of the scale depends on the temperature. Table 1 contains exemplary values, including thermal conductivity values lambda (λ) at different temperatures, on the one hand for the scale layer and on the other hand for a material made of steel:

TABLE 1

| | Lambda- Scale [W/m*K] | Lambda-Steel [W/m*K] |
|---|---|---|
| 900° C. | 1.35 | 28 |
| 1000° C. | 1.6 | 29 |
| 1200° C. | 2.1 | 31 |

The thermal conductivity of the scale layer is much smaller than that of the steel material. The heat transfer coefficient of the scale is defined as:

$$\alpha_z(D_z, \lambda_z) = \left(\frac{\lambda_z}{D_z}\right) \tag{15}$$

Here $\alpha_Z(D_Z, \lambda_Z)$ denote the heat transfer coefficient of the scale, $D_Z$ the thickness of the scale and $\lambda_Z$ the coefficient of thermal conductivity (thermal conductivity) of the scale.

With the heat transfer coefficient of the scale, the surface temperature of the scale layer $T_Z$ can be calculated via the heat balance and from this the heat radiation of the metal strip B to the environment can be determined. The layer of scale thus reduces cooling of the metal strip B.

A precise knowledge of the behavior of the scale layer is important for the correct calculation of the temperature development in the cooling device 10.

Figure 7A:
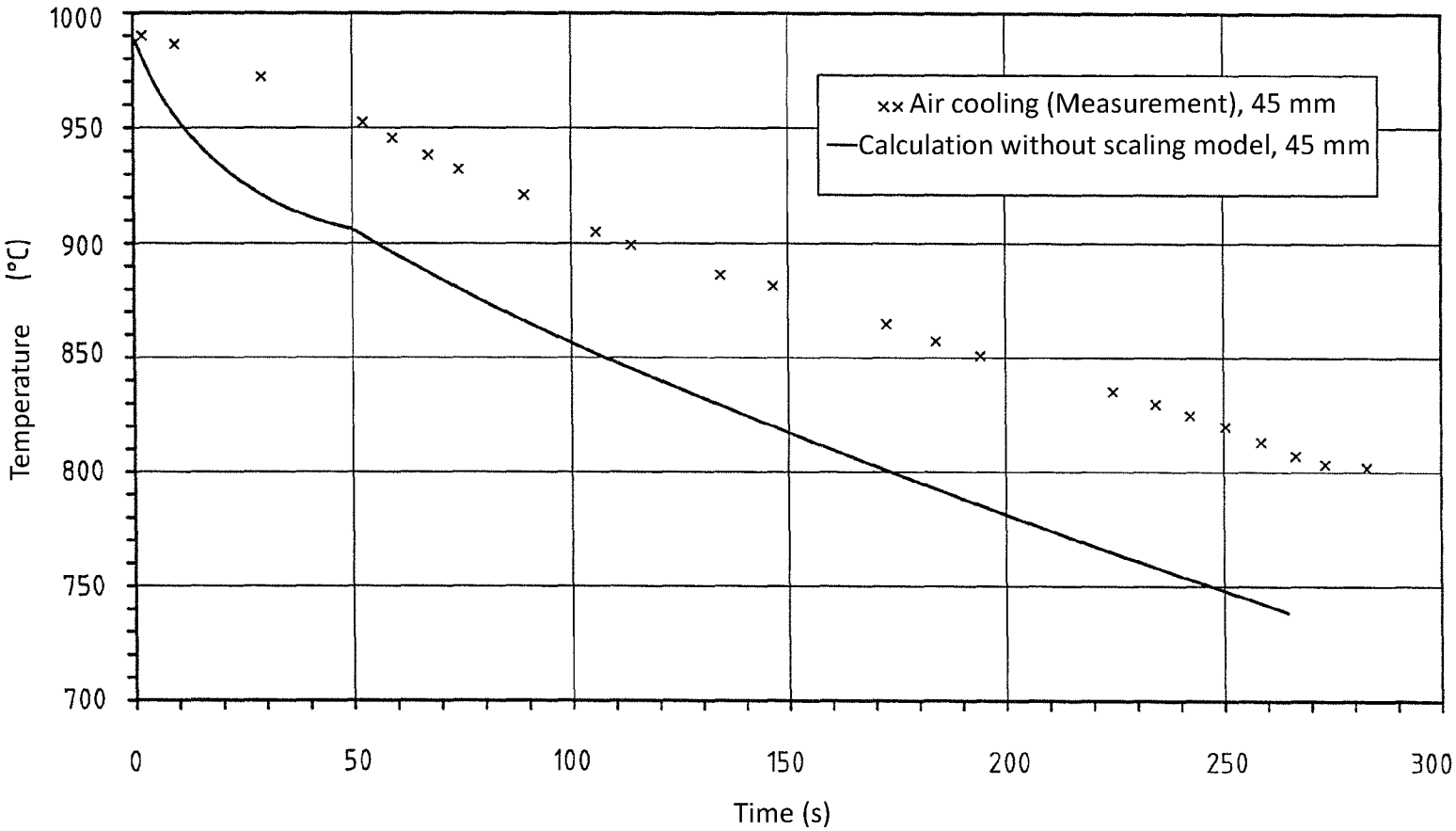
FIG. 7*a* is a diagram showing, by way of example, a calculated and measured temperature profile as a function of time without taking the influence of scale into account.
Figure 7B:
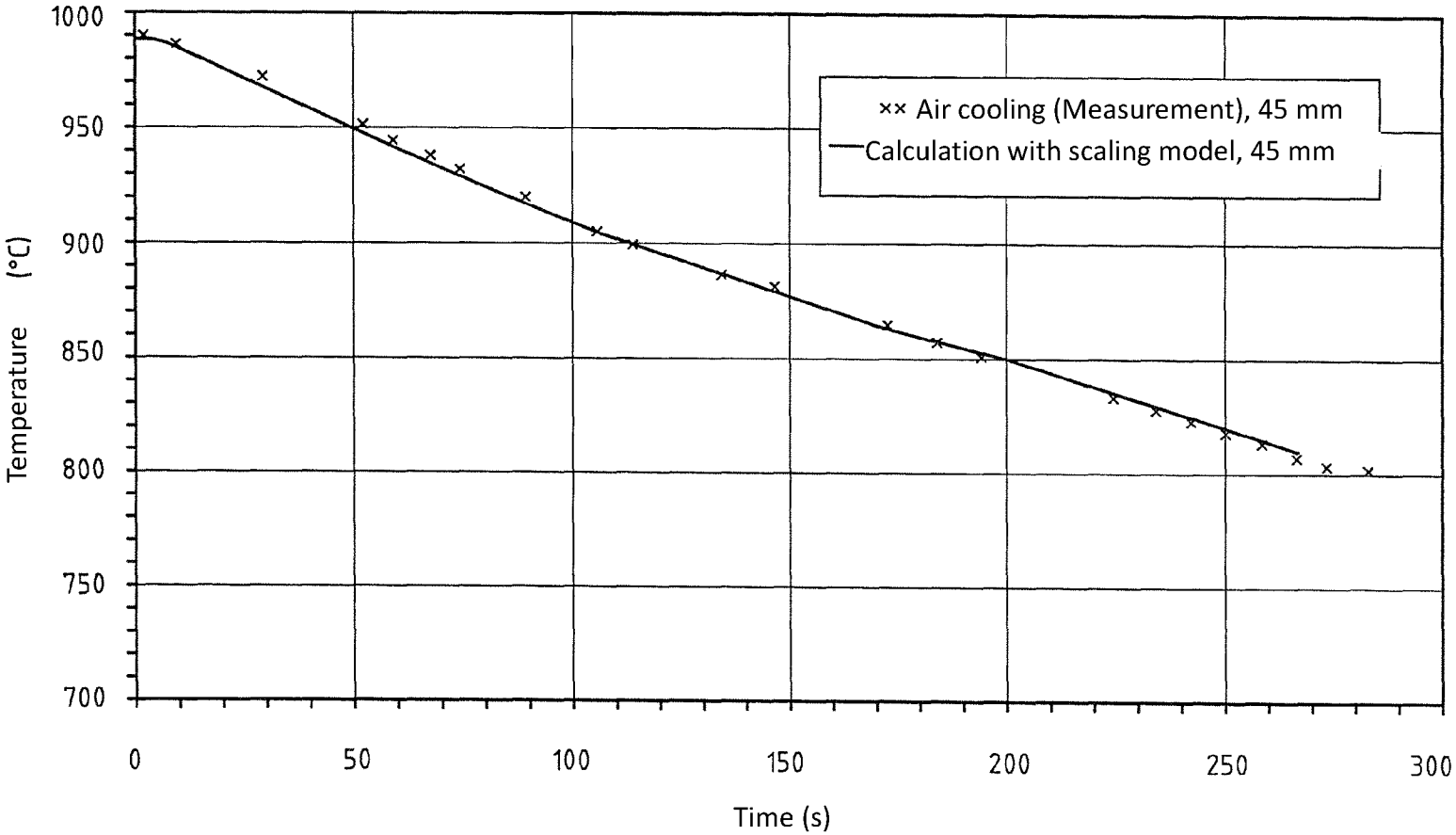
FIG. 7*b* is a showing, by way of example, a calculated and measured temperature profile as a function of time, taking into account the influence of scale.

FIG. 7*a* is a diagram which shows, by way of example, a calculated and measured temperature profile as a function of time without taking the influence of scale into account. A large discrepancy between measurement and calculation can be seen here. In contrast, FIG. 7*b* shows the calculated and measured temperature profile as a function of time, taking into account the influence of scale. A good correspondence between calculation and experiment can be seen.

Figure 8:
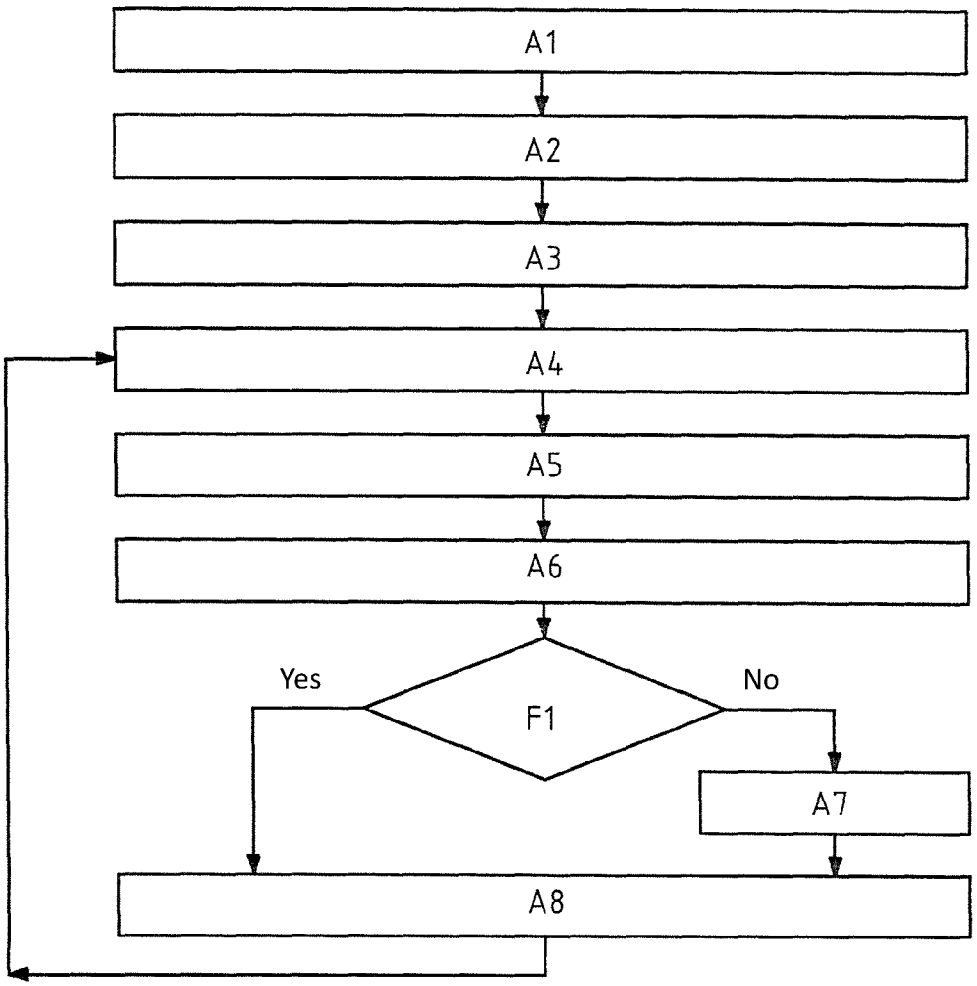
FIG. 8 is a flow chart illustrating an exemplary process sequence for regulating the cooling device according to FIG. 1.

In the following, an exemplary process sequence for using the model, i.e., for determining the temperature distribution in the metal strip B, and for regulating or activating the cooling device 10, is described using the flow chart in FIG. 8:

The input or control variables of the model are the surface temperatures of the metal strip B, which are determined by the temperature measuring devices 20, 21. If a surface temperature is specified as the setpoint at the outlet of the cooling device 10, the temperature calculation model in the control device 30 calculates the amount of cooling water required to achieve the desired surface temperature of the metal strip B passing through the cooling device 10. The calculated values of the temperature distribution in the metal strip B are immediately visible and can be used for the control and/or regulation of the cooling device 10 and, if necessary, the downstream finishing train 2 of the rolling train. The values for the temperature distribution are updated with each new cyclical or iterative calculation.

First, in a first step A1, the process is prepared, which includes: calculating the Gibbs energy and the enthalpy curve for each phase and each temperature; Determining the scale factor; Creation of a TTT diagram; and determining the coefficient of thermal conductivity and density for all pure phases as a function of temperature from regression equations.

The calculation network for the current strip geometry (strip width and strip thickness) is then created in a step A2.

In the following step A3, the initial conditions for the subsequent iteration are established. The workpiece temperature or the rolled stock temperature T downstream of the roughing train 1 is set to an initial value $T_0$ for all calculation nodes. The scale thickness is set to 0 mm and the average cooling rate, for example, to 5 K/s as a default value.

The iteration begins with step A4 with: determining the phase boundaries and microstructural proportions from the TTT diagram for the current mean cooling rate; Calculating the enthalpy as a function of the temperature from the enthalpies of the pure phases and the phase distribution; and calculating the coefficients of thermal conductivity and densities from the pure phases and the phase distribution.

In step A5, the enthalpy H is determined from the current node temperature T for all calculation nodes.

In step A6, equation (1) is numerically solved to calculate the entire course of enthalpy and temperature over time.

Subsequently, the deviation of the setpoint value from the actual value of the surface temperature is determined in F1 and compared with a threshold value or a tolerance (for example ±2° C.). If the deviation is within the tolerance ("yes"), the next iteration step takes place in step A8. If the deviation is outside the tolerance ("no"), an adaptation/change of the operation of the cooling device 10 takes place before the next iteration step according to A8, preferably an adaptation of the amount of cooling medium output by the nozzles 11*a*.

The method presented here makes it possible to set the optimum inlet temperature of the metal strip B into the finishing train 2 by regulating the cooling device 10 during rolling without pauses. Depending on the application, i.e., depending on the forming process, this means avoiding unnecessary productivity losses. The cooling device 10, in particular as a pre-strip cooling, reduces surface defects due to the formation of scale.

The temperature calculation model and its implementation as a method or in the control device 30 enables the temperature distribution within the metal strip B in the cooling device 10 to be calculated with greater accuracy, whereby a material-dependent, optimal amount of the cooling medium, preferably water, can be set and controlled in the cooling device 10. Since the total enthalpy can be specified as an input variable in the temperature calculation for almost all materials currently produced worldwide with the Gibbs energies and the conversion temperatures can be determined very precisely using calculated TTT diagrams, the temperature calculation can be carried out particularly precisely and with the greatest possible reliability of the input data.

Furthermore, the method enables a homogenization of temperature irregularities in the metal strip B (pre-strip) over the length and/or the width via a cooling performance of the cooling device 10 that can be set in a defined manner.

Furthermore, the method takes into account the formation of scale and includes a calculation of the scale layer thickness on the metal strip B, as a result of which the calculation of the heat output of the metal strip B before and after cooling is optimized.

The data calculated to regulate the cooling device 10 can be passed on to a preset model of a possible subsequent finishing train 2 (for example caloric mean temperature, grain size, or the like).

With the disclosed method, the cooling medium quantities required for cooling can be determined and regulated in the cooling device 10 in such a way that the inlet temperature required in the inlet of the finishing train 2 is reached exactly. In addition, low inlet temperatures can be used in a targeted manner to increase the rolling speed and thus increase production.

While many of the features and numerical examples given herein relate to a metal strip B made of steel, all types of suitable metal strips B, for example made of an aluminum, nickel or copper alloy, are included. The model presented here and its application as a method and in the control device 30 can also be applied to metal strips B of such materials.

As far as applicable, all of the individual features set out in the exemplary embodiments can be combined with one another and/or exchanged without departing from the scope of the invention.

LIST OF REFERENCE SYMBOLS

1 roughing train
1*a* roll stand
2 finishing train
2*a* roll stand
10 cooling device
11 nozzle arrangement
11*a* nozzle
20 temperature measuring device
21 temperature measuring device
30 control device
B metal strip
F direction of conveyance

The invention claimed is:

1. Method for controlling a cooling device (10), which is configured to control the temperature of a rolling stock, preferably metal strip (B), which runs through the cooling device (10) along a conveying direction (F), the cooling device (10) being arranged upstream of a rolling train, the method comprising:

determining a total enthalpy of the system formed by the rolling stock;

determining a measure for the formation of scale, which preferably comprises a scale factor that depends on the chemical composition and the surface temperature of the rolling stock;

calculating a temperature distribution and/or average temperature in the rolling stock on the basis of a temperature calculation model, in which the determined total enthalpy and the measure for the formation of scale are included; and setting a cooling performance of the cooling device (10) taking into account the calculated temperature distribution and/or average temperature in the rolling stock.

2. Method according to claim 1, characterized in that the total enthalpy of the rolling stock is calculated from the sum of the free molar enthalpies of all the pure phases and/or phase fractions present in the rolling stock.

3. Method according to claim 1, characterized in that the temperature calculation model is based on a non-stationary heat equation, preferably on a partial differential equation which relates the spatial temperature distribution in the rolling stock to the development of the total enthalpy over time.

4. Method according to claim 1, characterized in that the sequence of determining the total enthalpy, calculating the temperature distribution and/or average temperature and setting the cooling performance takes place iteratively, so that a desired temperature distribution and/or average temperature in the rolling stock is approximated.

5. Method according to claim 1, characterized in that the setting of the cooling capacity of the cooling device (10) takes place in such a way that the cooling performance is changed if the calculated temperature distribution or a temperature value therefrom, preferably an average temperature or surface temperature, deviates by a tolerance or more of from a corresponding setpoint, and the cooling performance is otherwise not changed.

6. Method according to claim 1, characterized in that the cooling device (10) has a nozzle arrangement (11) with several nozzles (11*a*) which is configured to supply the nozzles (11*a*) with a fluid cooling medium, preferably water or a water mixture, the cooling performance of the cooling device (10) being adjusted by the amount of cooling medium output by the nozzles (11*a*).

7. Method according to claim 1, characterized in that one or more temperature measuring devices (20, 21) are provided, the measured values of which are included in the determination of the total enthalpy and/or determination of the degree of scale formation and/or in some other way in the temperature calculation model.

8. Method according to claim 1, characterized in that the cooling device (10) is arranged between a roughing train (1) and a finishing train (2), each of which has one or more roll stands for rolling the rolling stock.

9. Method according to claim 1, characterized in that with the calculation of the temperature distribution and/or average temperature in the rolling stock based on the temperature calculation model, the inlet temperature of the rolling stock in a rolling train, preferably a finishing train (2), arranged downstream of the cooling device (10) is calculated.

10. Method according to claim 1, characterized in that, when calculating the total enthalpy, phase transition temperatures are determined by means of a regression method which uses regression coefficients which are preferably obtained from a calculated or empirically obtained TTT diagram.

11. Method according to claim 1, characterized in that, within the framework of the temperature calculation model, the total enthalpy as the free molar total enthalpy H of the rolling stock by means of the Gibbs energy G at constant pressure p according to the equation $$H = G - T\left(\frac{\partial G}{\partial T}\right)p,$$

where T is the absolute temperature in Kelvin.

12. Method according to claim 1, characterized in that, within the framework of the temperature calculation model, the Gibbs energy G of the overall system as the sum of the Gibbs energies of the pure phases and their phase proportions according to the equation $$G = \sum_i f^i G^i,$$

where $f^i$ denotes the Gibbs energy fraction of the respective phase or the respective phase fraction in the overall system and Gi denotes the Gibbs energy of the respective pure phase or the respective phase fraction of the system, where the rolling stock preferably consists of steel, with proportions of austenite, ferrite and liquid phase, and the Gibbs energy of the respective phases in this case according to the following equation $$G^\phi = \sum_{i=1}^{n} x_i^\phi G_i^\phi + RT\sum_{i=1}^{n} x_i \ln x_i + {}^E G^\phi + {}^{magn}G^\phi,$$

where $G^\phi$ denotes the Gibbs energy of a respective phase $\phi$, $x_i^\phi$ the mole fraction of the i-th component of the respective phase $\phi$, $G_i^\phi$ the Gibbs energy of the i-th component of the respective phase $\phi$, R the general gas constant, T the absolute temperature in Kelvin, ${}^E G^\phi$ the Gibbs energy for a non-ideal mixture and ${}^{mag}G^\phi$ the magnetic energy of the system, where the Gibbs energy for a non-ideal mixture ${}^E G^\phi$ is preferably determined according to the equation $${}^E G^\phi = \Sigma x_i x_j {}^a L^\phi_{i,j}(x_i - x_j)^a + \Sigma x_i x_j x_k L_{i,j,k}{}^\phi$$

where $x_i$ is the mole fraction of the i-th component, xj is the mole fraction of the $j^{th}$ component, $x_k$ is the mole fraction of the k-$^{th}$ component, a is a correction term, ${}^a L^\phi_{i,j}$ and ${}^a L^\phi_{i,j,k}$ designate interaction parameters of various orders of the overall system formed by the rolling stock, whereby the component of the magnetic energy ${}^{mag}G^\phi$ is preferably determined according to the equation $${}^{mag}G^\phi = RT\ln(1+\beta)f(\tau)$$

where R is the general gas constant, T is the absolute temperature in Kelvin, $\beta$ is the magnetic moment and f(T) is the proportion of the overall system as a function of the normalized Curie temperature T of the overall system formed by the rolling stock, and preferably the conversion kinetics of the phases is determined via a diffusion-controlled approach according to the Enomoto equation.

13. Method according to claim 1, characterized in that, within the framework of the temperature calculation model, the thickness of the scale formed on the rolling stock after a period of time according to the following calculation formula $$D_Z(t+dt) = \sqrt{D_Z(t)^2 + F_Z \cdot dt}$$

$$\text{where } dt = \frac{d_Z}{v},$$

where $D_Z(t)$ is the thickness of the scale, t is the time, dt is the period of time, $F_Z$ is the scale factor, v is the conveying speed of the rolling stock and $d_Z$ denotes a distance covered at the conveying speed v in the period dt, where the scale factor $F_Z$ is determined as a function of the surface temperature of the rolling stock and its chemical composition, preferably according to the equation $$F_{Z=a\cdot e^{-b\cdot c\,\%}\cdot e^{-c/T_0}}$$

where $T_o$ is the surface temperature of the rolling stock and C % is the dimensionless concentration of carbon in the material of the rolling stock, a, b and c denote coefficients, preferably with a=9.8*107, b=2.08, c=17780, and the heat transfer coefficient of the scale is preferably taken into account according to the equation $$\alpha_z(D_z, \lambda_z) = \left(\frac{\lambda_z}{D_z}\right), \text{ where}$$

$\alpha_Z(D_Z, \lambda_Z)$ denoting the heat transfer coefficient of the scale, $D_Z$ the thickness of the scale and $\lambda_Z$ the coefficient of thermal conductivity of the scale.

14. Control device (30) for controlling a cooling device (10) which is configured to control the temperature of a rolling stock, preferably metal strip (B), which passes through the cooling device (10) along a conveying direction (F), the control device (30) being configured for carrying out a method according to claim 1.

* * * * *